US005998123A

United States Patent [19]

Tanaka et al.

[11] Patent Number: 5,998,123

[45] Date of Patent: Dec. 7, 1999

[54] SILVER HALIDE LIGHT-SENSITIVE COLOR PHOTOGRAPHIC MATERIAL

[75] Inventors: Shinri Tanaka; Michiko Nagato, both of Hino, Japan

[73] Assignee: Konica Corporation, Japan

[21] Appl. No.: 09/067,418

[22] Filed: Apr. 28, 1998

[30] Foreign Application Priority Data

May 6, 1997 [JP] Japan ..... 9-115585

[51] Int. Cl.[6] ..... G03C 1/08; G03C 7/26; G03C 7/32

[52] U.S. Cl. ..... 430/555; 430/503

[58] Field of Search ..... 430/503, 555

[56] References Cited

U.S. PATENT DOCUMENTS

| | | | |
|---|---|---|---|
| 4,584,266 | 4/1986 | Hirose et al. | 430/555 |
| 5,262,292 | 11/1993 | Krishnamurthy et al. | 430/555 |
| 5,350,667 | 9/1994 | Singer et al. | 430/555 |
| 5,376,519 | 12/1994 | Merkel et al. | 430/555 |
| 5,447,830 | 9/1995 | Pawlak et al. | 430/555 |
| 5,576,166 | 11/1996 | Sugita et al. | 430/555 |
| 5,605,787 | 2/1997 | Pawlak et al. | 430/555 |
| 5,610,003 | 3/1997 | Lussier | 430/555 |
| 5,663,040 | 9/1997 | Bertoldi et al. | 430/555 |
| 5,677,118 | 10/1997 | Spara et al. | 430/555 |

FOREIGN PATENT DOCUMENTS

| | | |
|---|---|---|
| 44 24 684 | 1/1996 | Germany . |
| 19 52 5666 | 10/1996 | Germany . |

*Primary Examiner*—Geraldine Letscher
*Attorney, Agent, or Firm*—Jordan B. Bierman; Bierman, Muserlian and Lucas

[57] ABSTRACT

A silver halide light-sensitive color photographic material is disclosed. A coupler represented by the formula is used.

12 Claims, No Drawings

SILVER HALIDE LIGHT-SENSITIVE COLOR PHOTOGRAPHIC MATERIAL

The present invention relates to a silver halide light-sensitive color photographic material, and more specifically, to a silver halide light-sensitive color photographic material which exhibits high sensitivity, high dye-forming efficiency, excellent color reproduction, and little dependence of spectral absorption wavelength of a formed dye on the density and the appropriate spectral absorption wavelength.

BACKGROUND OF THE INVENTION

At present, the subtractive color process is utilized in the silver halide light-sensitive color photographic materials (hereinafter, simply referred to as light-sensitive materials), and color images are formed by combining three prepared dyes employing a yellow coupler, a magenta coupler, and a cyan coupler.

Conventionally, as the magenta couplers employed in the silver halide light-sensitive color photographic materials, there have been known the pyrazolone series, the pyrazolotriazole series, the pyrazolinobenzimidazole series or the indanone series couplers. Of these, various types of 5-pyrazolone derivatives have been widely employed.

As the substituents at the 3-position of the 5-pyrazolone ring of the above-mentioned 5-pyrazolone derivatives, there are employed, for example, an alkyl group, an aryl group, or an alkoxy group described in U.S. Pat. No. 2,439,099, or an acylamino group described in U.S. Pat. Nos. 2,369,489 and 2,600,788, or an ureido group described in U.S. Pat. No. 3,558,319. However, the above-mentioned couplers have resulted in shortcomings such that the coupling reactivity with an oxidized developing agent is low to unable the formation of a magenta dye image with high density; the magenta dye image formed by color development exhibits a large secondary absorption in the blue light region, and the main absorption exhibits no sharp decrease at the long wavelength edge.

The 3-anilino-5-pyrazolone series couplers disclosed in U.S. Pat. Nos. 2,311,081, 3,677,764, 3,684,514, and U.K. Patent Nos. 956,261, 1,173,513, etc. exhibit advantages such as high coupling activity, high dye-forming efficiency, small secondary absorption in the blue region and the like. However, the maximum spectral absorption wavelength of dyes formed employing these 3-anilino-5-pyrazolone series couplers conventionally known in the art positions in the relatively shorter wavelength region. Their use in the silver halide light-sensitive color photographic materials for making color negatives deteriorates the color reproduction on resulting prints. Furthermore, there has been the so-called bleach fog problem, in that after finishing the development process, the oxidized developing agent reacts with the coupler in the bleach bath to cause an increase in fog.

In order to minimize the disadvantage in that the maximum spectral absorption wavelength of the formed dye occupies a position in the short wavelength region, various investigations have been made. As a result, 1-pentahalogenophenyl-3-anilino-5-pyrazolone series couplers are proposed in Japanese Patent Publication Open to Public Inspection No. 52-80027. Dyes prepared employing the above-mentioned couplers exhibit the maximum spectral absorption wavelength more preferably as compared to conventional couplers. However, these couplers have exhibited disadvantages such that the dye-forming efficiency is not sufficient enough, and the maximum spectral absorption wavelength of the formed dye depends on the density (so-called dichroism).

Furthermore, German Patent 19,525,666 discloses 4-(2-N-alkylsulfonamide)phenylthio-5-pyrazolones. However, these compounds have been found to be unsatisfactory, because image dyes formed employing these compounds exhibit disadvantages such that the maximum spectral absorption wavelength varies in accordance with the density, that is, dichroism is caused; the color reproduction is degraded because the maximum spectral absorption wavelength occupies a position in the shorter wavelength region and is not adapted to that of the conventional couplers for color negative film and that low sensitivity and low dye formation efficiency result.

The feature of the present invention is that a 3-anilino-4-arylthio-5-pyrazilone coupler comprises both a specified ballast (substituent of 3-anilino part) part (hereinafter referred to as a ballast) and a 4-arylthio group (hereinafter referred to as a coupling point substituent). The ballasts of the present invention are described in Japanese Patent Publication Open to Public Inspection Nos. 8-171186 and 7-82626. However, in those specifications, there is not described any of the coupling point substituent of the present invention, and based on the description, it is difficult to hit on the coupling point substituent. Further the couplers described in the above-mentioned patent have the disadvantage of high bleach fog, and the couplers of the present invention are clearly superior to those couplers.

Furthermore, German Patent No. 19,525,666 discloses couplers having a ballast (exemplified compound M-4= comparative compound of the present invention M-9) having a structure similar to the coupler of the present invention. However there is described no photographic performance. The inventors of the present invention traced the coupler and found the disadvantages such as low dye forming efficiency, large dichroism, and the like. In the specification of the above-mentioned patent, a ballast similar to the structure of the ballast of the present invention is only employed in compound M-4 and it is impossible to get technical concept to employ the ballast of the present invention. There is no description on the superiority obtained by employing the ballast of the present invention. Based on the description in Examples of the present invention, it will definitely be seen that the couplers of the present invention based on a technical concept not suggested in the above-mentioned German Patent exhibit surprisingly higher performance than those described in the above-mentioned German Patent.

SUMMARY OF THE INVENTION

A first object of the present invention is to provide a silver halide light-sensitive color photographic material which exhibits high sensitivity, high dye-forming efficiency, excellent color reproduction, and little dependence of spectral absorption wavelength of formed dye on the density and the appropriate spectral absorption wavelength.

A second object of the present invention is to provide a silver halide light-sensitive color photographic material which causes minimum bleach fog, comprises a thin layer, and exhibits excellent sharpness.

The silver halide light-sensitive color photographic material of the invention comprises a coupler represented by the formula (1).

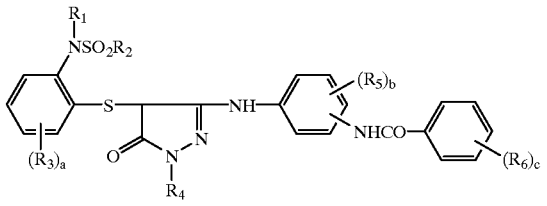

wherein $R_1$ represents an alkyl group; $R_2$ represents an aromatic group; $R_3$ represents a substituent; $R_4$ represents an aromatic group; $R_5$ and $R_6$ each independently represents a substituent, and a, b, and c each independently represents 0 to 4.

c is preferably 1 to 4, and at least one of $R_6$ substituts at the ortho position in respect to the carbamoyl group, already substituted. represented by the formula (2).

(2)

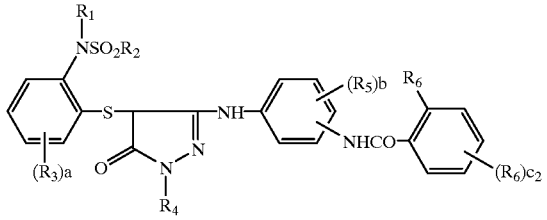

wherein $R_1$, $R_2$, $R_3$, $R_4$, $R_5$, $R_6$, a, and b are as defined above for $R_1$, $R_2$, $R_3$, $R_4$, $R_5$, $R_6$, a, and b in the general formula (1); $c_2$ represents 0 to 3.

The preferable example is represented by the formula (3).

(3)

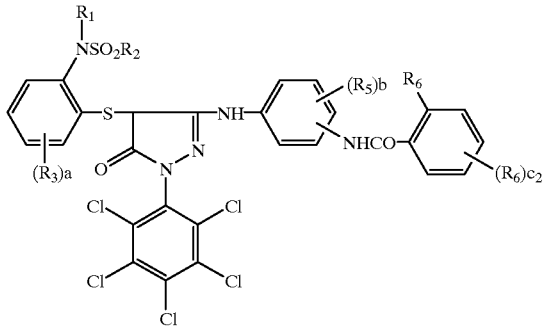

wherein $R_1$, $R_2$, $R_3$, $R_5$, a, and b are as defined above for $R_1$, $R_2$, $R_3$, $R_5$, a, and b in the general formula (1). $R_6$, and $c_2$ are as defined above for $R_6$, and $c_2$ in the formula (2), respectively.

In the preferable example of the coupler represented by formula (3) two of—($R_6$) are chlorine atoms or alkoxy groups and all these are substituted in the ortho position in respect to the carbamoyl group already substituted as represented by the formula (4).

(4)

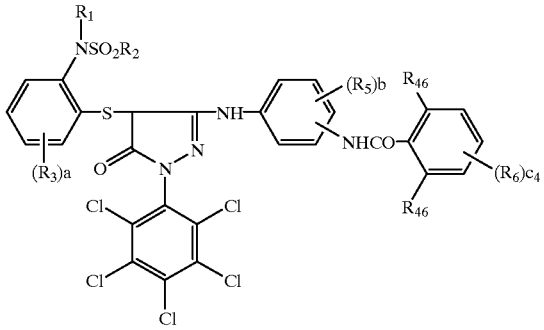

wherein—$R_{46}$ is each chlorine atoms or alkoxy group, and $c_4$ is an integer of 0 to 2. The other symbols are as defined above.

In the coupler represented by the formula (4) preferable one is represented by the formula (5).

(5)

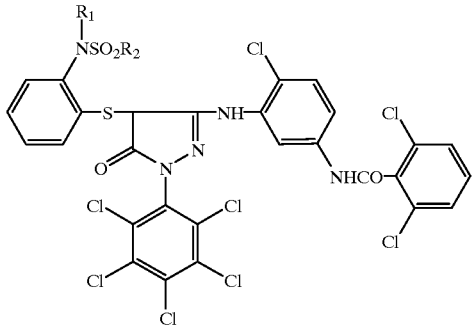

wherein $R_1$ represents an alkyl group and $R_2$ represents an aromatic group. More preferably, the coupler is represented by the formula (6).

(6)

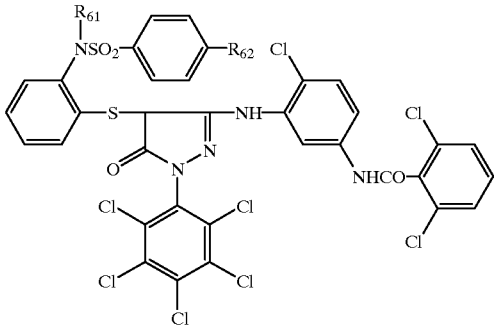

wherein $R_{61}$ represents an alkyl group having 5 to 12 carbon atoms and $R_{62}$ represents an aromatic group.

DETAILED DESCRIPTION OF THE INVENTION

Couplers are Described.

In the present invention couplers, $R_1$ represents an alkyl group and may specifically include a methyl, ethyl, n-propyl, i-propyl, n-butyl, t-butyl, n-hexyl, n-heptyl, n-octyl, n-decyl, n-dodecyl, 2-ethylhexyl group and the like.

$R_{61}$ represents an alkyl group having 5 to 12 carbon atoms, and specifically may include such groups as a n-hexyl, 2-ethylhexyl, n-octyl, n-decyl group, etc.

$R_1$ is preferably an alkyl group having 5 to 12 carbon atoms in terms of coupler solubility and dye-forming efficiency, and most preferably a n-octyl group. $R_{61}$ is an alkyl group having 5 to 12 carbon atoms and a n-octyl group based on the same reason as above.

In the present invention, $R_2$ represents an aromatic group. The specific examples may include a 4-methylphenyl group, a 4-chlorophenyl group, a phenyl group, a 4-dodecyloxyphenyl group, a 1-naphthyl group, etc.

$R_2$ is preferably a 4-alkylphenyl group in terms of coupler solubility and dye-forming efficiency, and is most preferably a 4-methylphenyl group.

$R_{62}$ represents a substituent, and the specific example may include groups similar to $R_5$. $R_{62}$ is preferably an alkyl group in terms of coupler solubility and dye-forming efficiency, and is most preferably a methyl group.

In the couplers of the present invention, $R_3$, $R_{23}$, $R_{33}$, and $R_{43}$ each independently represents a substituent, and the specific example may include, for example, a halogen atom (e.g. a fluorine atom, a chlorine atom, a bromine atom), an alkyl group (e.g. a methyl, ethyl, n-butyl, t-butyl, t-octyl, dodecyl, 2-ethylhexyl, 2-dodecyloxyethyl, 3-(2,4-di-tert-amylphenoxy)propyl, 2,2-dimethyl-2-(3-pentadecylphenoxy)ethyl group), an aryl group (e.g. a phenyl, a- or b-naphthyl, 2,4-dichlorophenyl, 2-methoxyphenyl, 4-docecyloxyphenyl, 2-chloro-5-tetradecanephenyl group), an alkoxy group (e.g. a methoxy, ethoxy, 2-dodecyloxyethoxy, 3-phenoxypropoxy, 2-ethoxyethoxy, octyloxy, 2-ethylhexyloxy, 2-(2,4-di-tert-pentylphnoxy)ethoxy group, etc.), an aryloxy group, (e.g. a phenoxy, a- or b-naphthoxy, 4-tert-butylphenoxy group), an alkylthio group (e.g. a methylthio, butylthio, octylthio, a-dodecyloxycarbonylpropylthio, 3-phenoxypropylthio, 2-butoxycarbonylethyl group), an arylthio group (e.g. a phenylthio, 4-tert-butylphenylthio, 2-butoxy-5-tert-octylphenylthio, 4-dodecyloxyphenylthio group), an alkylsulfonyl group (e.g. a methanesulfonyl, ethanesulfonyl, octanesulfonyl, or dodecanesulfonyl group, etc.), an arylsulfonyl group (e.g. a benzenesulfonyl, toluenesulfonyl, 4-hydroxyphenylsulfonyl, 2-butoxy-5-tert-octylphenylsulfonyl group), an acylamino group (e.g. an acetamido, 2-ethylhexanoylamido, hexadecaneamido, a-(2,4-di-tert-pentylphenoxy)acetamido, benzamido, 3-(2-ethylhexaneamide)benzamido, 2-pyridinecarbonamido, 2-chloro-4-t-hexylbenzamido group), an alkoxycarbonylamino group (e.g. an ethoxcarbonylamino group, a t-butoxycarbonylamino group, a 2-methylpropyloxycarbonylamino group) a sulfonamide group (e.g. a methanesulfonamido, butanesulfonamido, benzenesulfonamido, 2-butoxy-5-tert-octylbenzenesulfonamido, 4-dodecyloxybenzenesulfonamide group), a sulfamoyl group (e.g. an N-methylsulfamoyl, N,N-diethylsulfamoyl, N-tert-butylsulfamoyl, 3-(2,4-di-tert-pentylphenoxy) propylsulfamoyl group), an ureido group (e.g. a phenylureido, 4-cyanophenylureido, tetradecylureido, 4-ethanaesulfonylphenylureido group), an alkoxycarbonyl group (e.g. an ethoxycarbonyl, dodecylcarbonyl, benzyloxycarbonyl, 2-methylpropyloxycarbonyl group), an aryloxycarbonyl group (e.g. a phenoxycarbonyl, 2,4-di-tert-butyl-phenoxycarbonyl group), an acyl group (e.g. an acetyl, benzoyl, dodecanoyl, a-(2,4-di-tert-pentylphoxy)acetyl group), a carboxyl group, a cyano group, a trifluoromethyl group, an amino group, an N-arylamino group (e.g. an anilino, 2,4-dichloroanilino, 4-methoxyanilino, 2-chloro-5-tetradecaneanilino, 3-acetamidoanilino, 4-tert-octylanilino, a- or b-naphthylamino group), an N,N-dialkylamino group (e.g. an N,N-diethylamino, N-ethyl-N-dodecylamino, N,N-bis(2-dodecyloxyethyl)amino group), a diacylamino group (e.g. an N,N-diacetylamino, N-acetyl-N-benzamido group), an imido group (e.g. a succinimido, phthalimido, glutarimido, 1-benzyl-5,5-dimethyl-3-hydantoinyl, 5,5-dimethyl-2,4-dioxo-3-oxazolidinyl group), or a carbamoyl group (e.g. an N-ethylcarbamoyl, N-[3-(2,4-di-tert-pentylphenoxy)propyl]carbamoyl, N-ethyl-N-dodecylcarbamoyl, N-tert-octylcarbamoyl group) or such like.

Regarding the couplers of the present invention, $R_4$, and $R_{24}$ each independently represents an aromatic group, and may specifically include a phenyl group, a pentachlorophenyl group, a 2,4,6-trichlorophenyl group, a 2,5-dichlorophenyl group, a 2.3-dichlorophenyl group, a 2,6-dichloro-4-methanesulfonylphenyl group, etc. $R_4$ and $R_{24}$ each independently is preferably a pentachlorophenyl group in terms of the optimum maximum spectral absorption wavelength of the formed dyes.

Regarding the couplers of the present invention, $R_5$, $R_{25}$, $R_{35}$, and $R_{45}$ each independently represents a substituent, and may specifically include substituents represented by the above-mentioned $R_3$.

Regarding the couplers of the present invention, $R_6$, $R_{26}$, $R_{36}$, and $R_{46}$ each independently represents a substituent, and may specifically include substituents represented by $R_5$.

In respect to minimum dichroism and high dye-forming efficiency, $R_6$, $R_{26}$, $R_{36}$, and $R_{46}$ each independently preferably has a substituent in the ortho position with respect to the carbamoyl group already substituted, and more preferably has substituents in both the ortho positions. The type of the substituent is preferably a chlorine atom or an alkoxy group, more preferably a chlorine atom or a methoxy group, and most preferably a chlorine atom.

Regarding the couplers of the present invention, a, a2, a3, and a4 each independently represents an 0 to 4, and is preferably 0. b, b2, b3, and b4 each independently represents 0 to 4 and is preferably 1. c, c2, c3, and c4 each independently represents 0 to 4 and is preferably 2.

The specific examples of representative couplers of the present invention are illustrated below. However, the present invention is not limited to these examples.

Exemplified compound

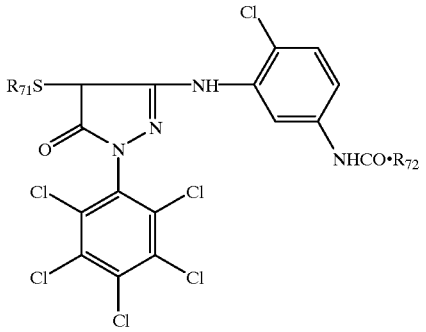
| | $R_{71}$ | $R_{72}$ |
|---|---|---|
| 1 | 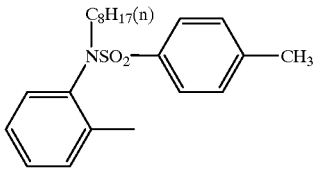 | 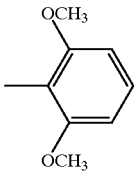 |
| 2 " | | 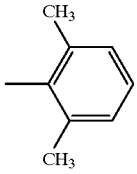 |
| 3 " | | 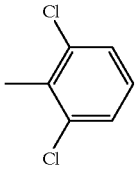 |
| 4 " | | 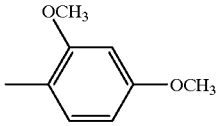 |
| 5 " | | 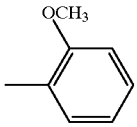 |
| 6 " | | 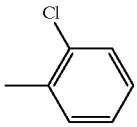 |
| 7 | 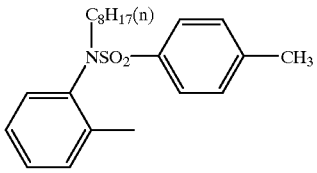 | 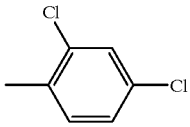 |

-continued
| | | |
|---|---|---|
| 8 | " | 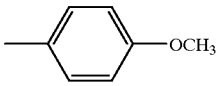 |
| 9 | " | 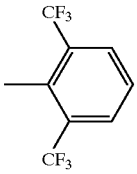 |
| 10 | " | 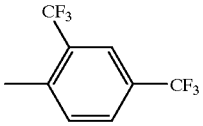 |
| 11 | " | 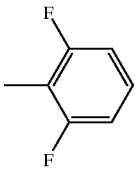 |
| 12 | " | 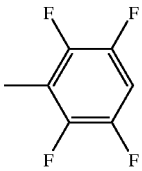 |
| 13 | " | 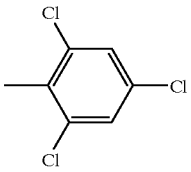 |
| 14 | 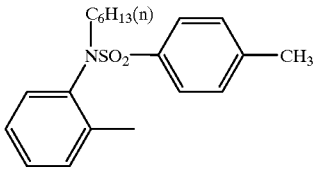 | 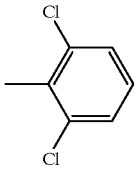 |
| 15 | 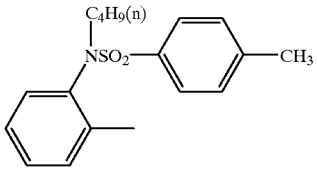 | " |
| 16 | 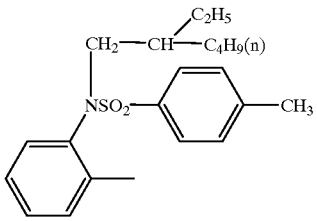 | " |

-continued
| | | |
|---|---|---|
| 17 | 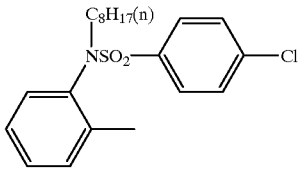 | " |
| 18 | 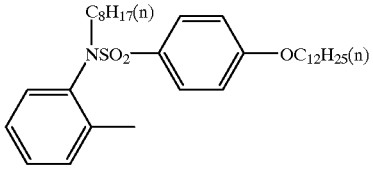 | " |
| 19 | 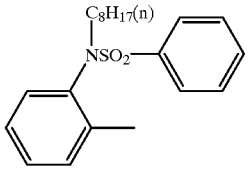 | 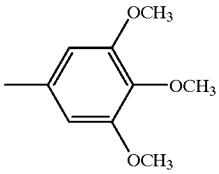 |
| 20 | 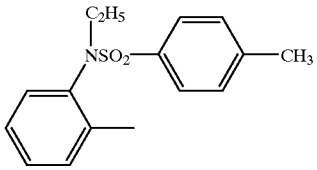 | 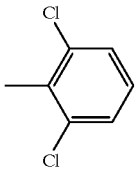 |
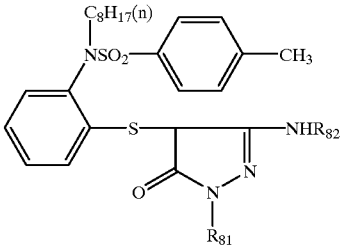
| $R_{81}$ | $R_{82}$ |
|---|---|
| 21 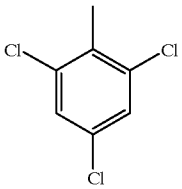 | 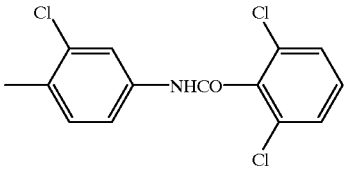 |
| 22 " | 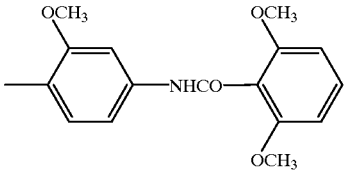 |

-continued

| | | |
|---|---|---|
| 23 | 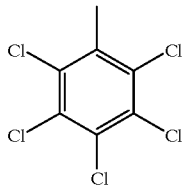 | 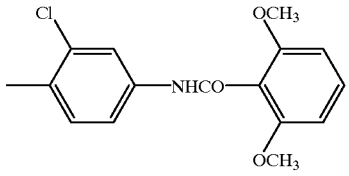 |

The specific synthesis example of the coupler of the present invention is described below. However, the coupler may be synthesized with reference to the synthesis methods described in, for example, U.S. Pat. Nos. 2,369,489, 2,376,380, 2,472,581, 2,600,788, 2,933,391, 3,615,506; U.K. Patent Nos. 956,261, 1,134,329; German Patent No. 19,525,666; Japanese Patent Publication No. 45-20636; Japanese Patent Publication Open to Public Inspection Nos. 2-39148, 2-27343, 8-171186 and the like.

The specific synthesis example of the coupler of the present invention is described below.

Synthesis Example 1

Synthesis of Exemplified Compound 3

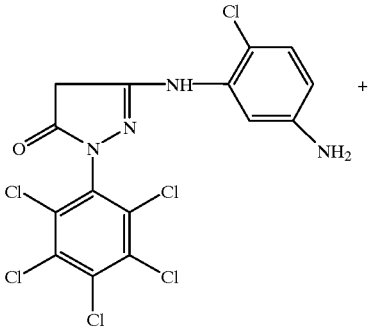

Compound 1

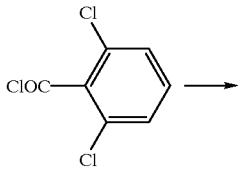

Compound 2

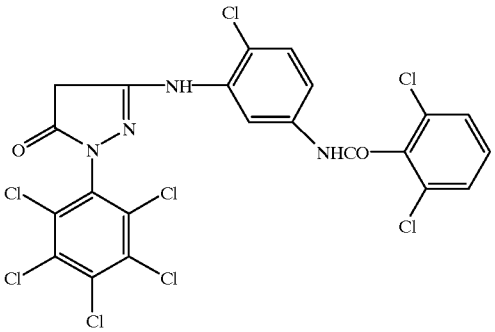

Compound 3

To 19.10 g of 2,6-dichlorobenzoic acid, 60 ml of thionyl chloride was added and heated at 60 to 65° C. for 1.5 hours. Thionyl chloride was removed by distillation under reduced pressure and a light yellow oil (Compound 2) was obtained.

To 35.47 g of Compound 1, 150 ml of ethyl acetate, 75 ml of water, and 12.30 g of sodium acetate anhydride were added, and the total amount of Compound 2 was added to the resulting mixture with stirring at room temperature. After stirring for 4 hours, the deposit was collected through filtration; was consecutively washed with 100 ml of water, 50 ml of methanol, and 50 ml of ethyl acetate in this order and was subsequently dried. Thus 32.7 g (yield 67%) of Compound 3, in the form of a light brown powder, was obtained.

The structure of Compound 3 was identified utilizing NMR spectra and mass spectra. The Compound exhibited a melting point of not lower than 300 ° C.

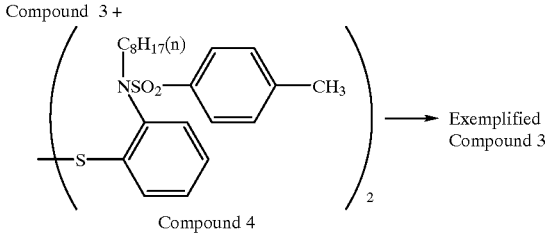

Compound 4

At 25° C., 9.37 g of Compound 4 was dissolved in 60 ml of ethyl acetate and was then added to 1.55 g of sulfuryl chloride. After stirring for 3 minutes, 12.92 g of Compound 3 and 10 ml of dimethylformamide were added and the resulting mixture was heated at 50° C. for 2 hours. The resulting solution was added to 50 ml of ethyl acetate; was washed and dried to remove the solvent. The resulting compound was recrystalized from methanol and 18.3 g (yield 88%) of light yellow powder was obtained.

The structure of the Exemplified Compound 3 was identified utilizing mass spectra and NMR spectra. The purity obtained by HPLC was 98.8%. The melting point was 145° C.

Physical values of the Exemplified Compounds synthesized in the same manner as mentioned above are shown below.

| Exemplified Compound Number | m.p. |
|---|---|
| 14 | 199 to 201° C. |
| 15 | 244 to 246° C. |

The couplers of the present invention may be employed generally in the range of $1\times10^{-3}$ to $8\times10^{-1}$ mol per mol of silver halide, and preferably in the range of $1\times10^{-2}$ to $8\times10^{-1}$ mol.

The couplers of the present invention may be employed in combination with other types of magenta couplers.

For incorporation of the couplers of the present invention, several conventional methods are available, for example, the single coupler of the present invention or couplers thereof in combination are dissolved in a mixture consisting of a high-boiling point solvent such as dibutyl phthalate or tricresyl phosphate, etc., well known in the art, and a low-boiling point solvent such as butyl acetate, ethyl acetate, etc. or a solvent consisting only of low-boiling solvents; the resulting solution is then mixed with an aqueous gelatin-solution comprising a surface active agent; the resulting mixture is emulsify dispersed employing a high-speed rotation mixer, a colloid mill, or an ultrasonic homogenizer followed by adding the resulting dispersion to an emulsion. Moreover, the emulsified dispersion liquid may be set and cut into small pieces followed by washing them with water and then adding them to the emulsion.

The couplers of the present invention may be dispersed independently employing a high-boiling point solvent and the above-mentioned dispersing method and added to a silver halide emulsion. However, the preferred method is that both compounds are dissolved at the same time; dispersed and added to the emulsion.

The added amount of the above-mentioned high-boiling point solvent is preferably in the range of 0.01 to 10 g per g of the coupler of the present invention and more preferably in the range of 0.1 to 3.0 g. Furthermore, the coupler may be dissolve dispersed only in a low-boiling point solvent, without using a high-boiling point solvent, and added to the emulsion.

As the silver halide emulsion employed in the light-sensitive material of the present invention, any of ordinary silver halide emulsions may be employed. The emulsion may undergo chemical sensitization and spectral sensitization at the desired wavelength region employing a sensitizing dye.

To the silver halide emulsion, may be added antifoggants, stabilizers and the like. As the binder for the emulsion, gelatin is advantageously employed.

Emulsion layers and other hydrophilic colloid layers may be hardened and may also comprise plasticizers, water-insoluble or slightly water-soluble synthesized polymer dispersions (latex). Couplers are incorporated in the emulsion layers of a light-sensitive color photographic material.

Furthermore, there may be employed a colored coupler exhibiting a color correction effect and competing couplers, and compounds which release photographically effective fragments such as a development accelerator at the coupling reaction with an oxidized developing agent, a bleach accelerator, a developing agent, a silver halide solvent, a toning agent, a hardener, a fogging agent, an antifoggant, a chemical sensitizer, a spectral sensitizer, and a desensitizer.

As supports, may be employed paper laminated with polyethylene and the like, polyethylene terephthalate film, baryta paper, cellulose triacetate and the like.

Color images may be obtained by exposing the light-sensitive material of the present invention followed by generally known color photographic processes.

EXAMPLES

The specific examples of the present invention are described below. However, the embodiments of the present invention are not limited to these examples.

Example 1

The added amount of the additive in the silver halide light-sensitive photographic material is hereunder the number of grams per $m^2$, unless otherwise specified. Further, the amounts of silver halide and colloid silver are expressed in terms of silver, and the added amount of the sensitizing dye is expressed with the number of moles per mole of silver.

One side (the surface) of a triacetyl cellulose film support was subjected to subbing treatment. Thereafter, on the reverse side (back side) of the support subjected to the subbing treatment, layers composed of compositions described below were coated successively in the order from the support side. Further, the added amount is expressed in a weight per $m^2$.

| 1st Layer on the Back Side | |
|---|---|
| Aluminasol AS-100 (aluminum oxide) (manufactured by Nissan Kagaku Kogyo Co., Ltd.) | 0.1 g |
| Diacetyl cellulose | 0.2 g |

| 2nd Layer on Back side | |
|---|---|
| Diacetyl cellulose | 100 mg |
| Stearic acid | 10 mg |
| Fine silica particles (average diameter 0.2 mm) | 50 mg |

On the surface of the support subjected to the subbing treatment, each layer having the composition described below was successively formed in the order from the support side and thus, a multilayer light-sensitive color photographic material 1 was prepared.

| 1st Layer: antihalation layer (HC) | |
|---|---|
| Black colloid layer | 0.15 |
| UV absorbing agent (UV-1) | 0.20 |
| Compound (CC-1) | 0.02 |
| High-boiling point solvent Oil-1) | 0.20 |
| High-boiling point solvent Oil-2) | 0.20 |
| Gelatin | 1.6 |

| 2nd Layer: interlayer (IL-1) | |
|---|---|
| Gelatin | 1.3 |

| 3rd Layer: slow red-sensitive emulsion layer (R-L) | |
|---|---|
| Iodobromide emulsion (average grain diameter 0.3 mm) (average iodine content 8.0 mole %) | 0.4 |
| Iodobromide emulsion (average grain diameter 0.4 mm) (average iodine content 8.0 mole %) | 0.3 |
| Sensitizing dye (S-1) | $3.2 \times 10^{-4}$ |
| Sensitizing dye (S-2) | $3.2 \times 10^{-4}$ |
| Sensitizing dye (S-3) | $0.2 \times 10^{-4}$ |
| Cyan coupler (C-1) | 0.50 |
| Cyan coupler (C-2) | 0.13 |
| Colored cyan coupler (CC-1) | 0.07 |
| DIR compound (D-1) | 0.006 |
| DIR compound (D-2) | 0.01 |
| High-boiling point solvent (Oil-1) | 0.55 |
| Gelatin | 1.0 |

| 4th Layer: fast red-sensitive emulsion layer (R-H) | |
|---|---|
| Iodobromide emulsion (average grain diameter 0.7 mm) (average iodine content 7.5 mole %) | 0.9 |
| Sensitizing dye (S-1) | $1.7 \times 10^{-4}$ |
| Sensitizing dye (S-2) | $1.6 \times 10^{-4}$ |
| Sensitizing dye (S-3) | $0.1 \times 10^{-4}$ |
| Cyan coupler (C-2) | 0.23 |
| Colored cyan coupler (CC-1) | 0.03 |

-continued

| | |
|---|---|
| DIR compound (D-1) | 0.006 |
| DIR compound (D-2) | 0.02 |
| High-boiling point solvent (Oil-1) | 0.25 |
| Gelatin | 1.0 |

5th Layer: interlayer (IL-2)

| | |
|---|---|
| Gelatin | 0.8 |

6th Layer: slow green-sensitive emulsion layer (G-L)

| | |
|---|---|
| Iodobromide emulsion (average grain diameter 0.4 mm) (average iodine content 8.0 mole %) | 0.6 |
| Iodobromide emulsion (average grain diameter 0.3 mm) (average iodine content 2.0 mole %) | 0.2 |
| Sensitizing dye (S-4) | $6.7 \times 10^{-4}$ |
| Sensitizing dye (S-5) | $0.8 \times 10^{-4}$ |
| Magenta coupler (M-a) | 0.35 |
| Colored magenta coupler (CM-1) | 0.05 |
| DIR compound (D-3) | 0.02 |
| Additive 1 | 0.10 |
| High-boiling point solvent (Oil-2) | 0.7 |
| Gelatin | 1.0 |

7th Layer: fast green-sensitive emulsion layer (G-H)

| | |
|---|---|
| Iodobromide emulsion (average grain diameter 0.7 mm) (average iodine content 7.5 mole %) | 0.9 |
| Sensitizing dye (S-6) | $1.1 \times 10^{-4}$ |
| Sensitizing dye (S-7) | $2.0 \times 10^{-4}$ |
| Sensitizing dye (S-8) | $0.3 \times 10^{-4}$ |
| Magenta coupler (M-a) | 0.20 |
| Colored magenta coupler (CM-1) | 0.02 |
| DIR compound (D-3) | 0.004 |
| High-boiling point solvent (Oil-2) | 0.35 |
| Additive 1 | 0.07 |
| Gelatin | 1.0 |

8th Layer: yellow filter layer (YC)

| | |
|---|---|
| Yellow colloid silver | 0.1 |
| Additive (SC-1) | 0.12 |
| High-boiling point solvent (Oil-2) | 0.15 |
| Gelatin | 1.0 |

9th Layer: slow blue-sensitive emulsion layer (B-L)

| | |
|---|---|
| Iodobromide emulsion (average grain diameter 0.3 mm) (average iodine content 2.0 mole %) | 0.25 |
| Iodobromide emulsion (average grain diameter 0.4 mm) (average iodine content 8.0 mole %) | 0.25 |
| Sensitizing dye (S-9) | $5.8 \times 10^{-4}$ |
| Yellow coupler (Y-1) | 0.6 |
| Yellow coupler (Y-2) | 0.32 |
| DIR compound (D-1) | 0.003 |
| DIR compound (D-2) | 0.006 |
| High-boiling point solvent (Oil-2) | 0.18 |
| Gelatin | 1.3 |

10th Layer: fast blue-sensitive emulsion layer (B-H)

| | |
|---|---|
| Iodobromide emulsion (average grain diameter 0.8 mm) (average iodine content 8.5 mole %) | 0.5 |
| Sensitizing dye (S-10) | $3 \times 10^{-4}$ |
| Sensitizing dye (S-11) | $1.2 \times 10^{-4}$ |
| Yellow coupler (Y-1) | 0.18 |
| Yellow coupler (Y-2) | 0.10 |
| High-boiling point solvent (Oil-2) | 0.05 |
| Gelatin | 1.0 |

11th Layer: 1st protective layer (PRO-1)

| | |
|---|---|
| Iodobromide emulsion (average grain diameter 0.08 mm) | 0.3 |
| UV absorber (UV-1) | 0.07 |
| UV absorber (UV-2) | 0.10 |
| High-boiling point solvent (Oil-1) | 0.07 |
| High-boiling point solvent (Oil-3) | 0.07 |
| Gelatin | 0.8 |

12th Layer: 2nd protective layer (PRO-2)

| | |
|---|---|
| Compound A | 0.04 |
| Compound B | 0.004 |
| Polymethylmethacrylate (average particle diameter 3 mm) | 0.02 |
| Methylmethacrylate:ethylmethacrylate: methacrylic acid = 3:3:4 (weight ratio) copolymer (average particle diameter 3 mm) | 0.13 |
| Gelatin | 0.5 |

Further, the above-mentioned Sample 1 comprises a dispersion aid SU-1, a coating aid SU-2, a hardener H-1, a stabilizer ST-1, an antiseptic DI-1, an antifoggants AF-1 and AF-2, and dyes AI-1 and AI-2.

C-1

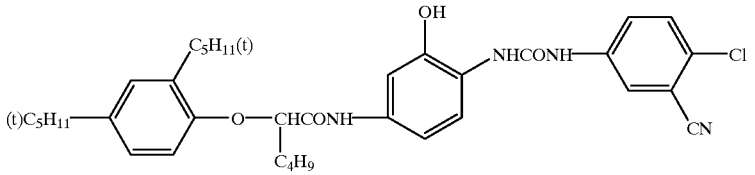

C-2

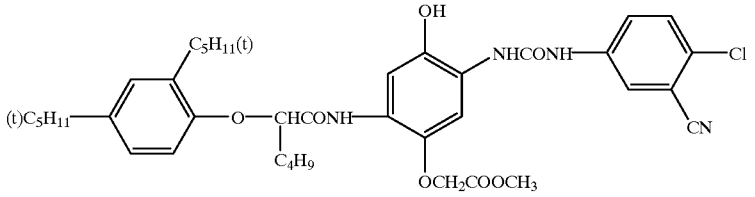

-continued
CM-1
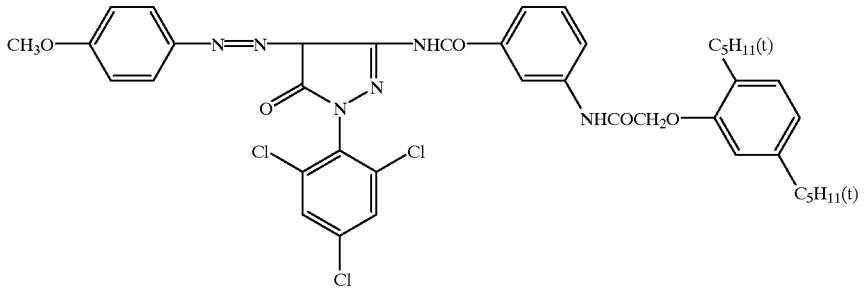
Y-1
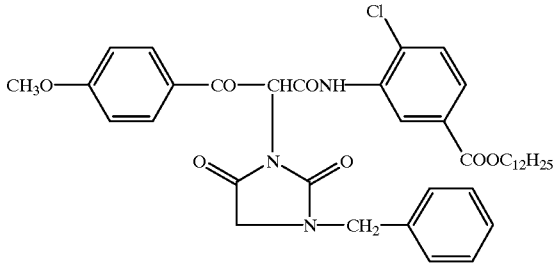
Y-2
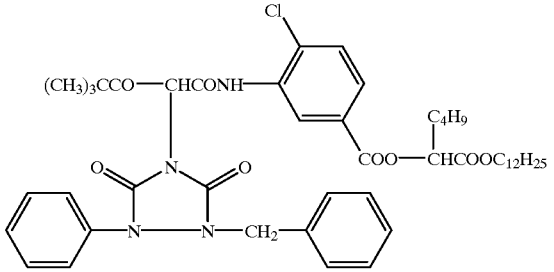
CC-1
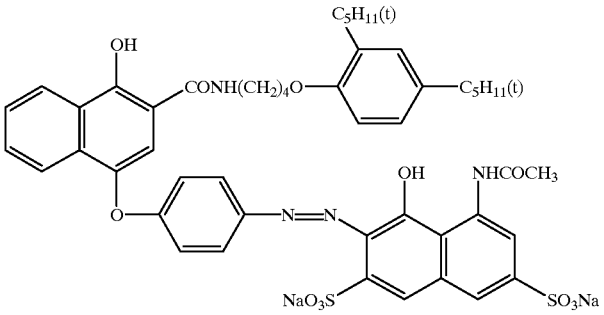
D-1
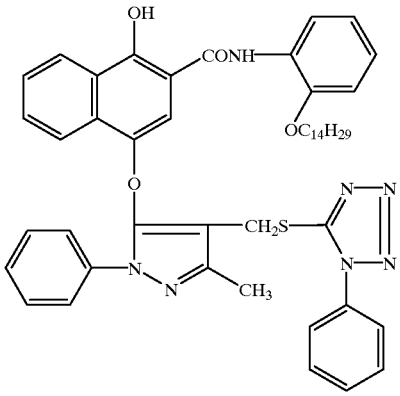

-continued
D-2
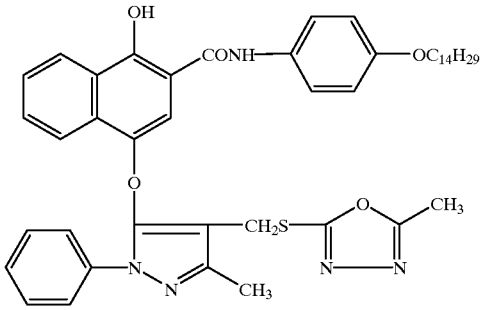
D-3
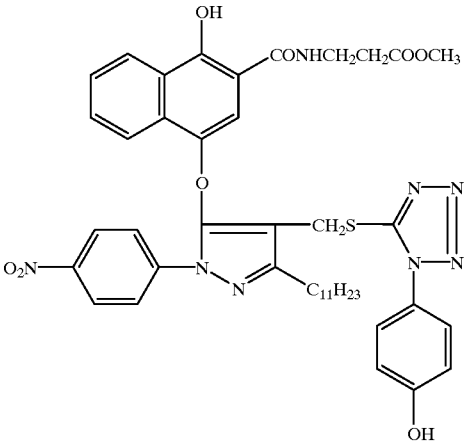
UV-1
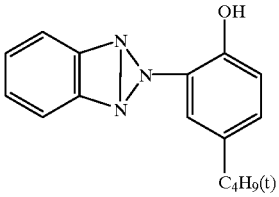
UV-2
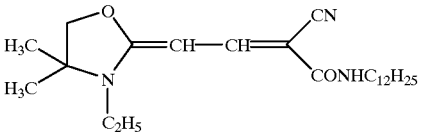
SC-1
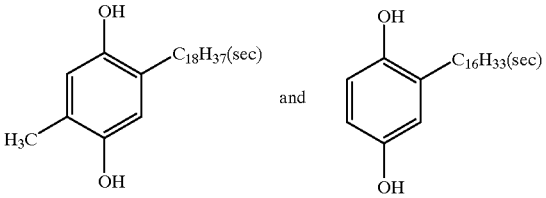
(mixture with mixing ratio of 2:3)
Oil-1
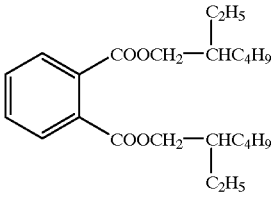

-continued
Oil-2
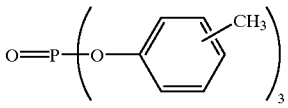
Oil-3
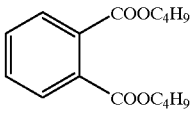
Compound A
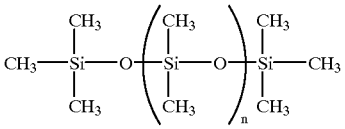
Weight average molecular weight = 3,000
Compound B
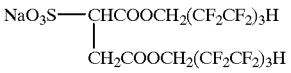
SU-1
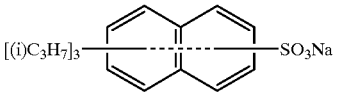
Additive 1
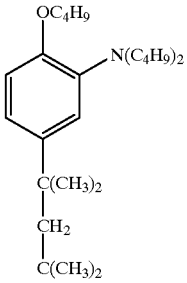
SU-2
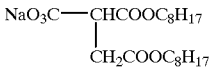
S-1
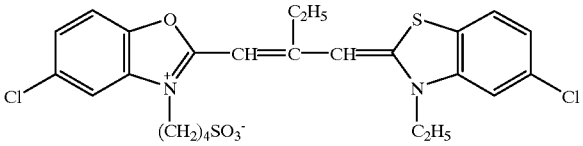
S-2
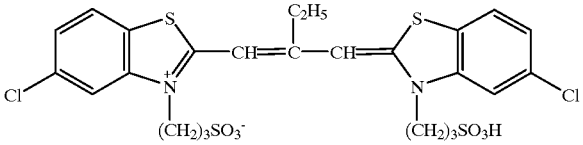
S-3
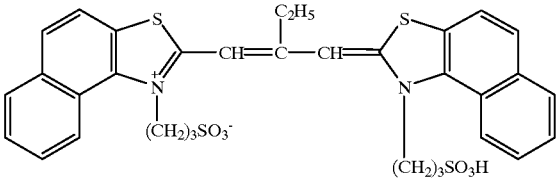

-continued
S-4
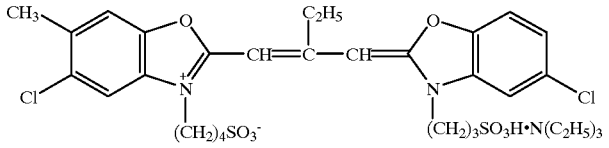
S-5
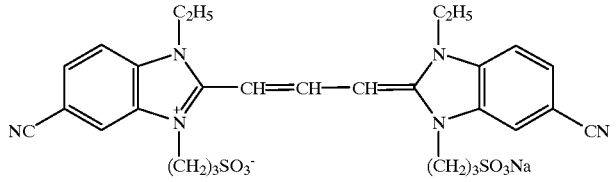
S-6
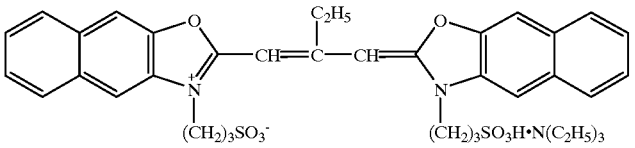
S-7
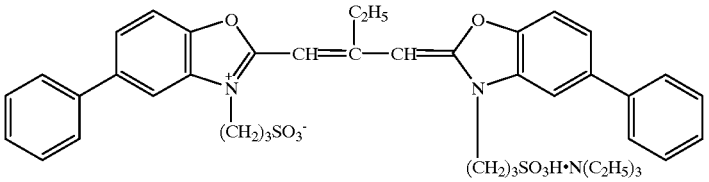
S-8
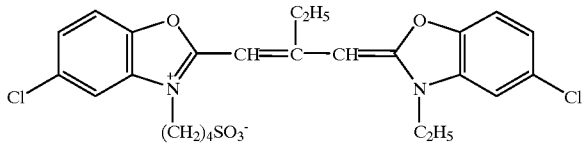
S-9
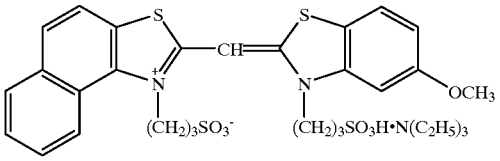
S-10
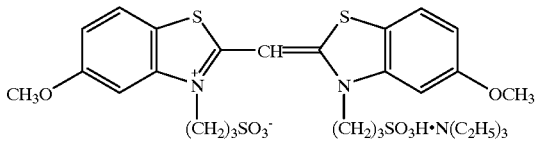
S-11
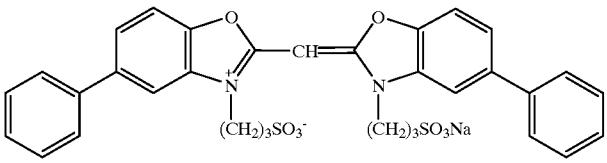

-continued
H-1
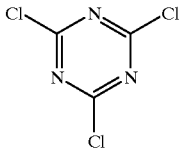
ST-1
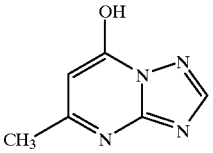
DI-1
Mixture of 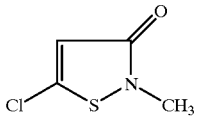 and 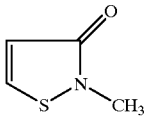
AF-1
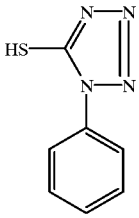
AF-2
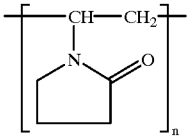
$\overline{Mw}$: 9,000
Al-1
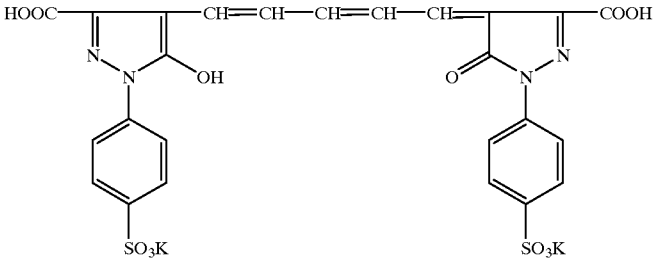
Al-2
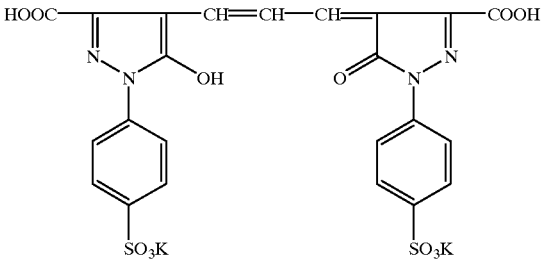

Samples 2 to 14 were prepared by replacing the magenta couplers incorporated into the 6th and 7th silver halide layers in the above-mentioned Sample 1 with those shown in Table 2 mentioned below.

Further, the added amount of magenta couplers incorporated into Samples 2 to 14 is the same moles as the magenta coupler incorporated into Sample 1.

M-a (Comparative coupler)

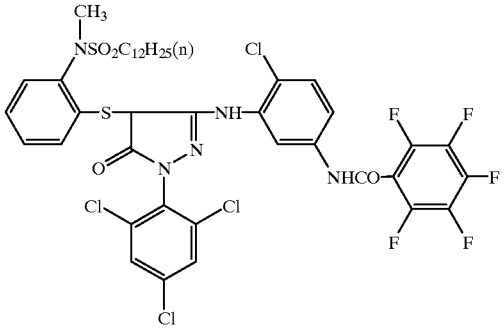

M-b (Comparative coupler)

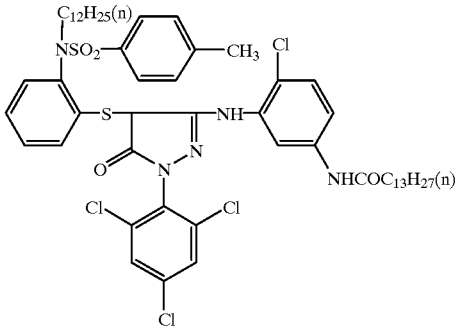

M-c (Comparative coupler)

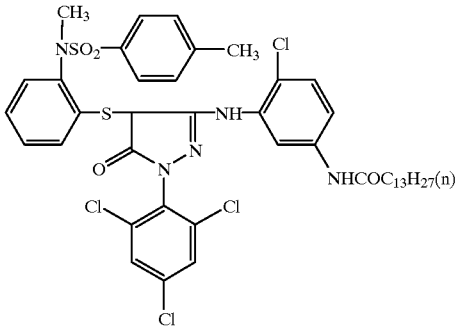

M-d (Comparative coupler)

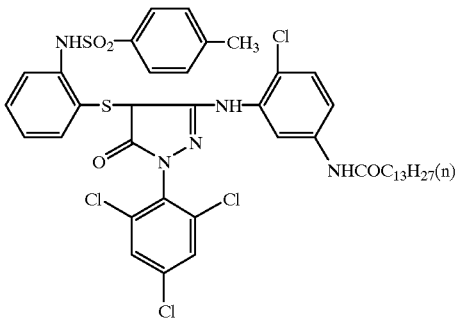

-continued

M-e (Comparative coupler)

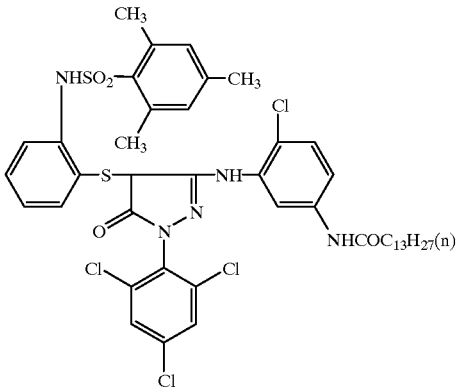

M-f (Comparative coupler)

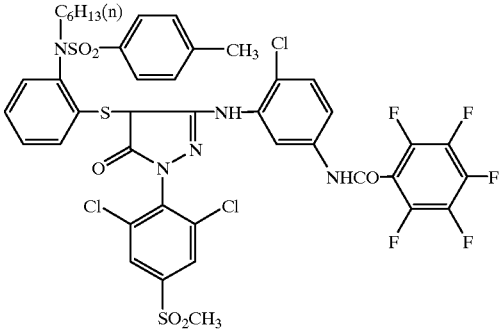

M-g (Comparative coupler)

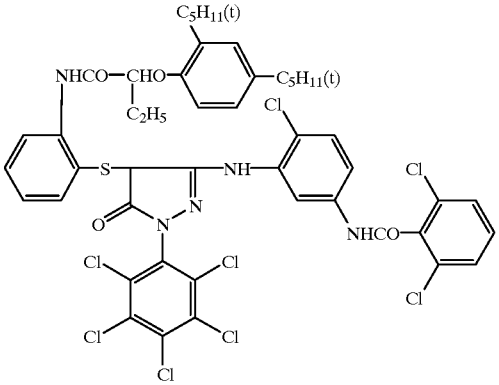

Samples 1 to 14, prepared as mentioned, were given exposures through a step wedge for sensitometry to green light and processed under the conditions mentioned below.

Processing Steps

TABLE 1

| Processing Step | Processing Time | Processing Temperature (° C.) | Replenisher Rate (cc) |
|---|---|---|---|
| Color Development | 3 min 15 sec | 38 ± 0.3 | 780 |
| Bleach | 45 sec | 38 ± 2.0 | 150 |
| Fix | 1 min 30 sec | 38 ± 2.0 | 830 |
| Stabilizing Bath | 60 sec | 38 ± 5.0 | 830 |
| Dry | 1 min | 55 ± 5.0 | — |

(Note:
Replenisher Rate is shown as a value per $m^2$.)

The color developer, bleach solution, fixer, and stabilizing bath, and each of the replenishers shown below were used.

| Color Developer | |
|---|---|
| Water | 800 ml |
| Potassium carbonate | 30 g |
| Sodium bicarbonate | 2.5 g |
| Potassium sulfite | 3.0 g |
| Sodium bromide | 1.3 g |
| Potassium iodine | 1.2 mg |
| Hydroxylamine sulfate | 2.5 g |
| Sodium chloride | 0.6 g |
| 4-Amino-3-methyl-N-ethyl-(b-hydroxyethyl) aniline sulfate | 4.5 g |
| Diethylelnetriaminepentaacetic acid | 3.0 g |
| Potassium hydroxide | 1.2 g |
| Water to make | 1 liter |
| The pH was adjusted to 10.06 using potassium hydroxide or 20% sulfuric acid. | |

| Color Developer Replenisher | |
|---|---|
| Water | 800 ml |
| Potassium carbonate | 35 g |
| Sodium bicarbonate | 3 g |
| Potassium sulfite | 5 g |
| Sodium bromide | 0.4 g |
| Hydroxylamine sulfate | 3.1 g |
| 4-Amino-3-methyl-N-ethyl-(b-hydroxyethyl)-aniline sulfate | 6.3 g |
| Potassium hydroxide | 2 g |
| Diethylelnetriaminepentaacetic acid | 3.0 g |
| Water to make | 1 liter |
| The pH was adjusted to 10.18 using potassium hydroxide or 20% sulfuric acid. | |

| Bleach solution | |
|---|---|
| Water | 700 ml |
| 1,3-Diaminopropanetetraacetic acid ferric ammonium | 125 g |
| Ethylenediaminetetraacetic acid | 2 g |
| Sodium nitrate | 40 g |
| Ammonium bromide | 150 g |
| Glacial acetic acid | 40 g |
| Water to make | 1 liter |
| The pH was adjusted to 4.4 using aqueous ammonia or glacial acetic acid. | |

| Bleach replenisher | |
|---|---|
| Water | 700 ml |
| 1,3-Diaminopropanetetraacetic acid ferric ammonium | 175 g |
| Ethylenediaminetetraacetic acid | 2 g |
| Sodium nitrate | 50 g |
| Ammonium bromide | 200 g |
| Glacial acetic acid | 56 g |
| The pH was adjusted to 4.4 using aqueous ammonia or glacial acetic acid; thereafter, water was added to make 1 liter. | |

| Fixier | |
|---|---|
| Water | 800 ml |
| Ammonium thiocyante | 120 g |
| Ammonium thiosulfate | 150 g |
| Sodium sulfite | 15 g |
| Ethylenediaminetetraacetic acid | 2 g |
| The pH was adjusted to 6.2 employing glacial acetic acid or aqueous ammonia, and water was then added to make 1 liter. | |

| Fixer Replenisher | |
|---|---|
| Water | 800 ml |
| Ammonium thiocyanate | 150 g |
| Ammonium thiosulfate | 180 g |
| Sodium sulfite | 20 g |

-continued

| | |
|---|---|
| Ethylenediaminetetraacetic acid | 2 g |
| The pH was adjusted to 6.5 employing glacial acetic acid or aqueous ammonia, and water was then added to make 1 liter. | |

| Stabilizing Bath and Stabilizing Bath Replenisher | |
|---|---|
| Water | 900 ml |
| $p\text{-}C_8H_{17}—C_6H_4—O—(CH_2CH_2O)_{10}H$ | 2.0 g |
| Dimethylolurea | 0.5 g |
| Hexamethylenetetramine | 0.2 g |
| 1,2-Benzisothiazoline-3-one | 0.1 g |
| Siloxane (L-77 manufactured by UCC) | 0.1 g |
| Aqueous ammonia | 0.5 ml |

Water was added to make 1 liter and the pH was then adjusted to 8.5 employing aqueous ammonia or 50% sulfuric acid.

After processing each of the above-mentioned samples, sensitometric characteristics were measured employing green light.

(Sensitivity)

Sensitivity was obtained as an inverse of the exposure amount necessary to yield a total density of 0.3 with fog density. Table 2 shows relative sensitivity when the sensitivity of Sample 1 was 100.

(Dye-forming Efficiency)

Table 2 shows the relative dye-forming efficiency represented by the relative maximum density when the maximum density of Sample 1 was 100.

(Bleach Fog)

The bleach fog was obtained as the difference between the minimum density (Dmin) obtained by processing each Sample with the above-mentioned bleach bath and the minimum density obtained by processing the corresponding Sample using an exhaustion-simulated bleach bath prepared by diluting one half the above-mentioned bleach bath with the addition of water, followed by adjusting the pH to 4.0.

(Spectral Absorption of a Formed Dye)

A Macbeth chart was photographed using each Sample, followed by being processed with the above-mentioned photographic processing solutions. Color Paper QA-A6 manufactured by Konica Corp. was exposed through the processed Sample and processed employing an Automatic Processor manufactured by Konica Corp. Reproduced colors on the finished print were compared to those on the Macbeth chart. The comparison was carried out based on the subjective evaluation of 10 persons.

○: all 10 persons judged that the color reproduction was good, by comparing the reproduced colors on the print to those on the Macbeth chart Δ: 8 to 9 persons judged that the color reproduction was good X: 7 or fewer persons judged that the color reproduction was good The results are shown in Table 2.

(Dichroism (Δlmax))

The difference between the maximum spectral absorption wavelength at maximum density and that at a density of approximately 1.0, was obtained employing the formula described below to be designated as dichroisim (Δlmax).

$$\Delta lmax = lmax_{(Dmax)} - lmax_{(D1.0)}$$

Table 2 shows the results.

TABLE 2

| Sample No. | Magenta Coupler | Relative Sensitivity | Relative Dye-forming Efficiency | Bleach Fog | Spectral Absorption of Formed Dye | Dichroism Almax (nm) | Remarks |
|---|---|---|---|---|---|---|---|
| 1 | M-a | 100 | 100 | 0.08 | X | 8 | Comp. |
| 2 | M-b | 110 | 110 | 0.08 | X | 2 | Comp. |
| 3 | M-c | 100 | 95 | 0.08 | X | 2 | Comp. |
| 4 | M-d | 90 | 90 | 0.08 | X | 2 | Comp. |
| 5 | M-e | 95 | 90 | 0.08 | X | 2 | Comp. |
| 6 | M-f | 90 | 75 | 0.08 | X | 6 | Comp. |
| 7 | M-g | 160 | 130 | 0.24 | ○ | 1 | Comp. |
| 8 | M-3 | 160 | 130 | 0.07 | ○ | 1 | Inv. |
| 9 | M-14 | 160 | 125 | 0.07 | ○ | 1 | Inv. |
| 10 | M-15 | 150 | 120 | 0.07 | ○ | 1 | Inv. |
| 11 | M-23 | 145 | 120 | 0.07 | ○ | 2 | Inv. |
| 12 | M-2 | 140 | 120 | 0.07 | ○ | 2 | Inv. |
| 13 | M-21 | 140 | 120 | 0.07 | Δ | 2 | Inv. |
| 14 | M-8 | 130 | 120 | 0.07 | ○ | 2 | Inv. |

Comp.: Comparative
Inv.: Present Invention

As can clearly be seen in Table 2, Samples 1 to 7 employing Comparative Couplers exhibit low sensitivity, low maximum density, high bleach fog, an inappropriate maximum absorbtion wavelength, and a large shift of maximum absorption wavelength due to the variation in density. The Comparative Compound M-f which combines the structure of M-4 disclosed in German Patent 19,525,666 with that of M-6, which exhibited the best performance, is very inferior to the couplers of the present invention in terms of all respects in sensitivity, dye-forming efficiency, spectral absorption of the formed dye, and dichroism. The superiority of the couplers of the present invention is definite. Samples 8 to 14 employing the couplers of the present invention are found to exhibit high sensitivity, high maximum density, low bleach fog, appropriate maximum spectral absorption wavelength, and small shift of the maximum spectral absorption wavelength due to the variation in density. Furthermore, as shown in Table 2, the couplers of the present invention exhibit high maximum density which enables a decrease in the added amount of the coupler and a decrease in the layer thickness, as a result, sharpness is improved.

Firstly, the present invention can provide a silver halide light-sensitive color photographic material which exhibits high sensitivity, high dye-forming efficiency, excellent color reproduction, little dependence of maximum spectral absorption wavelength on the density and the appropriate maximum spectral absorption wavelength, and secondly can provide a silver halide light-sensitive color photographic material which exhibits minimum bleach fog, comprises a layer with a decrease in thickness and exhibits improved sharpness.

We claim:

1. A silver halide light-sensitive color photographic material having a sillver halide emulsion layer provided on a support, wherein the silver halide light-sensitive color photographic material comprises a coupler represented by formula (1), (1)

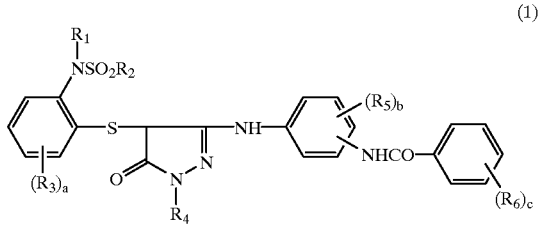

wherein $R_1$ represents an alkyl group; $R_2$ represents an aromatic group; $R_3$ represents a substituent; $R_4$ represents an aromatic group; $R_5$ and $R_6$ each independently represents a substituent, and a, b, and c each independently represents 0 to 4.

2. The silver halide light-sensitive color photographic material of claim 1 wherein $R_1$ is an alkyl group having 5 to 12 carbon atoms.

3. The silver halide light-sensitive color photographic material of claim 2 wherein $R_1$ is a n-octyl group.

4. The silver halide light-sensitive color photographic material of claim 1 wherein $R_2$ is a 4-methylphenyl group, a 4-chlorophenyl group, a phenyl group, a 4-dodecyloxyphenyl group or a 1-naphthyl group.

5. The silver halide light-sensitive color photographic material of claim 1 wherein c is 1 to 4, and at least one of $R_6$ substituts at the ortho position in respect to the carbamoyl group.

6. The silver halide light-sensitive color photographic material of claim 5 wherein the coupler is represented by formula (3), (3)

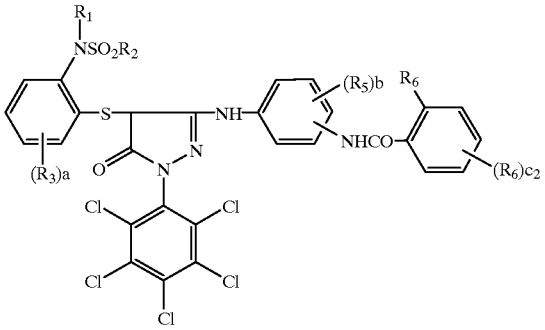

wherein $R_1$, $R_2$, $R_3$, $R_5$, a, and b are as defined above for $R_1$, $R_2$, $R_3$, $R_5$, a, and b in the formula (1). $R_6$, and $c_2$ are as defined above for $R_6$, and $c_2$ is 0 to 3.

7. The silver halide light-sensitive color photographic material of claim 6 wherein the coupler is represented by formula (4), (4)

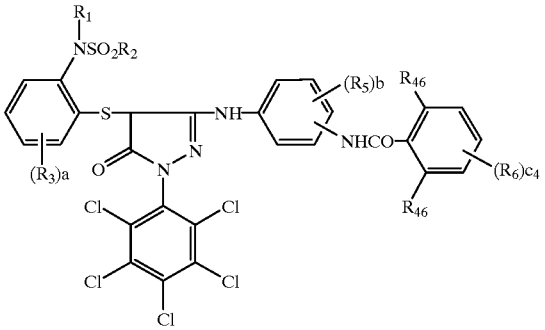

wherein $R_{46}$ is each chlorine atoms or alkoxy group, and $c_4$ is 0 to 2.

8. The silver halide light-sensitive color photographic material of claim 7 wherein the coupler is represented by formula (5)

(5)

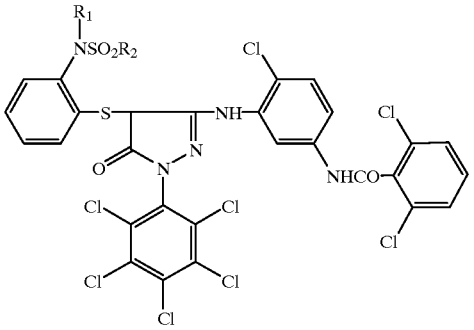

wherein $R_1$ represents an alkyl group and $R_2$ represents an aromatic group.

9. The silver halide light-sensitive color photographic material of claim 8 wherein the coupler is represented by formula (6)

(6)

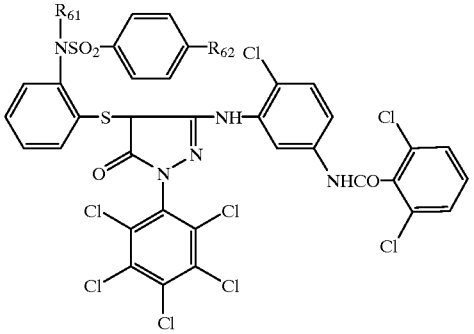

wherein $R_{61}$ represents an alkyl group having 5 to 12 carbon atoms and $R_{62}$ represents a substituent.

10. The silver halide light-sensitive color photographic material of claim 9 wherein $R_{61}$ is a n-hexyl, 2-ethylhexyl, n-octyl or n-decyl group.

11. The silver halide light-sensitive color photographic material of claim 9 wherein $R_{62}$ is an alkyl group.

12. The silver halide light-sensitive color photographic material of claim 11 wherein $R_{62}$ is a methyl group.

* * * * *